United States Patent [19]

Heikel

[11] 4,390,779

[45] Jun. 28, 1983

[54] METHOD AND APPARATUS FOR DETECTING ARTICLES MOVING IN A CONTINUOUS STREAM

[75] Inventor: Rodney W. Heikel, Mocksville, N.C.

[73] Assignee: R. J. Reynolds Tobacco Company, Winston-Salem, N.C.

[21] Appl. No.: 162,272

[22] Filed: Jun. 23, 1980

[51] Int. Cl.[3] ..... G06M 7/04; G06M 7/08

[52] U.S. Cl. ..... 377/6; 235/98 C; 377/8

[58] Field of Search ..... 235/92 PK, 92 V, 92 PD, 235/98 C

[56] References Cited

U.S. PATENT DOCUMENTS

| | | | |
|---|---|---|---|
| 3,717,751 | 2/1973 | Fluck | 235/98 PK |
| 3,720,815 | 3/1973 | Lovenzen | 235/92 PD |
| 3,790,759 | 2/1974 | Mohan et al. | 235/92 V X |
| 3,935,997 | 2/1976 | Loje | 235/98 C |
| 4,057,709 | 11/1977 | Lyngsgaard et al. | 235/92 PK |
| 4,217,491 | 8/1980 | Dufford, Jr. et al. | 235/98 C X |

*Primary Examiner*—David H. Malzahn

*Attorney, Agent, or Firm*—Grover M. Myers; Joseph E. Root, III

[57] ABSTRACT

A method and apparatus for counting indeterminately spaced articles traveling in a continuous stream. Successive individual lead articles of the stream are diverted from their direction of movement in an oblique direction. A sensor located beneath the stream at the point of oblique movement detects the sequential presence and absence of articles which information is accumulated to obtain a count. For counting rod-shaped articles, such as cigarettes, the method may be embodied in a drum having a helical groove to move the rods, the drum being located above a reflective scanning sensor head.

5 Claims, 7 Drawing Figures

METHOD AND APPARATUS FOR DETECTING ARTICLES MOVING IN A CONTINUOUS STREAM

TECHNICAL FIELD

This invention pertains to the field of detecting articles moving in a continuous stream.

BACKGROUND OF THE INVENTION

Accurate count of input and output in a manufacturing process is one of the most critical items of management information. An input count for a cigarette-making machine is difficult to obtain, however, because of the nature of the process.

In the production step preceding the making machine, other apparatus form a continuous tobacco rod and feed it axially toward the making machine. Adjacent to the maker, the rod is cut into cigarette-size pieces and, moving as an axial stream, is fed into the making machine. Mechanical methods cannot be used to count the cigarettes here due to the high speed of operation (4000 pieces per minute or more) and the fragility of the product. Conventional photoelectric means were also tried, without success. Such methods depend on detecting the gaps between individual articles; here, the stream of cigarettes is being pushed from the rear, so no gap exists. Several methods were employed in an effort to induce a gap between articles. The most promising of these was to accelerate successive cigarettes forward, using a drum or other means. The cigarette diameter varies, however, within manufacturing tolerances, and it was found that, if the acceleration mechanism was set to handle the smaller articles, it deformed the larger ones; conversely, if set not to deform larger cigarettes, it failed to accelerate many of the smaller ones, resulting in unreliable counts.

Therefore, a need exists for a method of counting cigarettes being fed into the making machine. Such a method must not only be capable of operation within the given process parameters, but also it must be adaptable to the size and environmental constraints imposed by existing machinery.

SUMMARY OF THE INVENTION

It is, therefore, an object of this invention to provide a method for counting articles traveling in a continuous stream.

Another object of this invention is to provide apparatus to count articles which are fed in a stream of abutting pieces at high speed.

These and other objects are accomplished by the present invention through the use of a sensor mounted beneath the stream of articles and a drum mounted over the stream. The drum has a helical groove cut in its peripheral surface. As an individual article advances, it passes over the sensor, enabling it to detect the presence of an article. Simultaneously, it is engaged by the helical drum. The sides of the helical groove impart a transverse motion which, combined with the existing forward motion, results in a net movement in an oblique direction. As the article is jogged out of its previous path of travel, the sensor is uncovered, allowing it to detect the absence of an article.

The combination of "present" and "absent" signals causes the counter to index the total by one. The lack of a space between articles is thus immaterial; the oblique movement of successive lead articles insures that the sensor will receive one "present" and one "absent" signal for each individual article in the stream.

DESCRIPTION OF A PREFERRED EMBODIMENT

Figure 1:
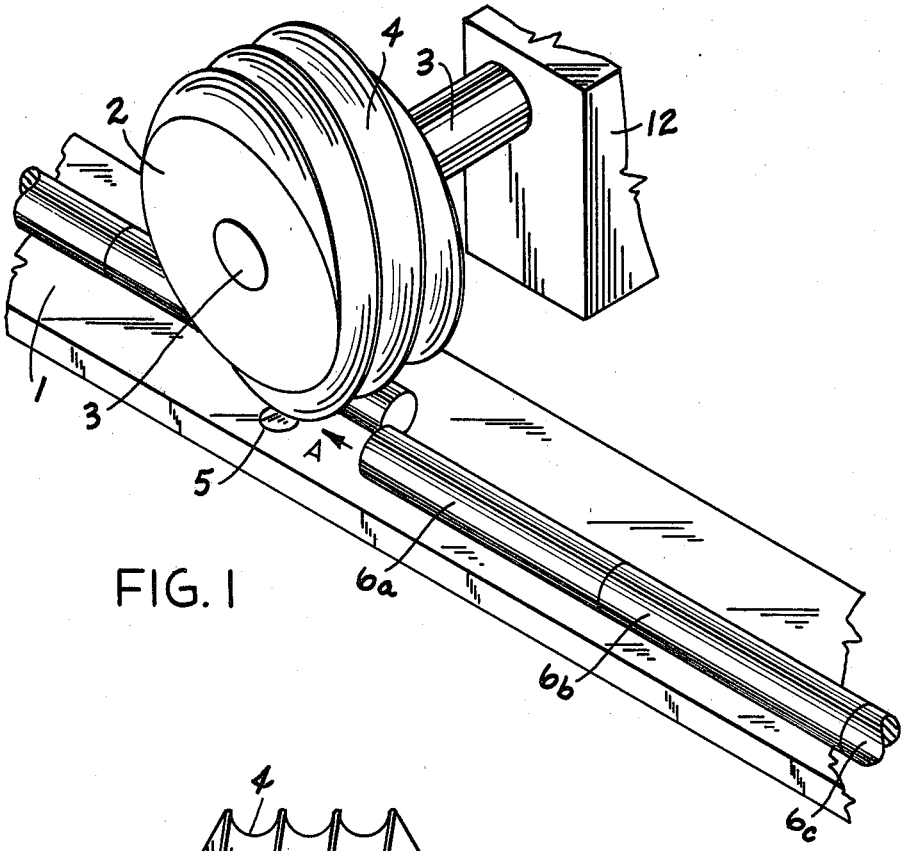
FIG. 1 is a perspective of the feed mechanism for a cigarette making machine incorporating the present invention.

FIG. 1 depicts an embodiment of the present invention in a cigarette-making process. The invention, however, can be adapted to any environment in which it is desired to count a stream of successive articles. It should be noted that the invention performs equally well when gaps never exist between articles, when gaps sometimes exist, or when gaps always exist; the existence of such spaces is made immaterial. It is the inability of conventional counting methods reliably to cope with indeterminate spacing presented in the first two situations, that calls for the present invention.

The stream of articles, 6*a*, 6*b* and 6*c*, is here shown emerging from a forming and cutting apparatus (not shown). The stream is being pushed from the rear across a flat bridge 1 toward a cigarette making machine (not shown).

Figure 2:
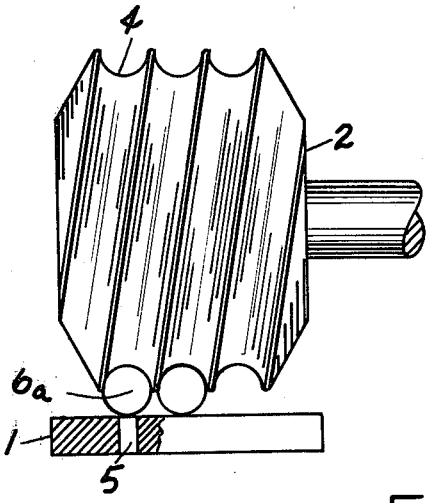
FIG. 2 is a view of the bottom of the helical drum in operation.
Figures 3A, 3B, 3C, 3D:
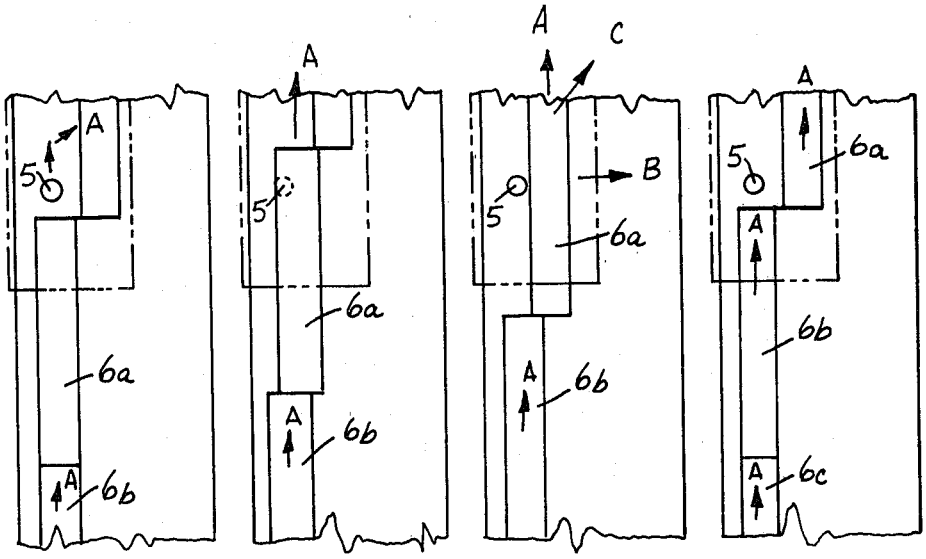
FIGS. 3*a* through 3*d* are a series of plan top views depicting the motions of cigarettes that permit counting according to the present invention.

Directly in the path of the stream of articles is a helical drum 2 or other suitable mechanism, such as a wheel. A helical groove 4 is formed into the peripheral surface of the drum. The angle of the groove with respect to the sides of the drum may be chosen as desired. In the preferred embodiment, the groove describes three revolutions around the drum. Similarly, the drum may be driven by any suitable means. Here, gearbox 12 connects to the cigarette making machine drive mechanism and rotates the drum in synchronization with the making machine. A short axle 3 extends from the gearbox and is keyed, or otherwise suitably fastened, to the drum. The drum is positioned over the bridge 1 as shown in FIG. 2 so that the outer edge of the drum is located slightly to the left of the path of the stream of articles, as seen from the articles' direction of travel. The depth of the groove and the spacing of the drum above the bridge should be selected to accommodate the articles without damage.

Figure 4:
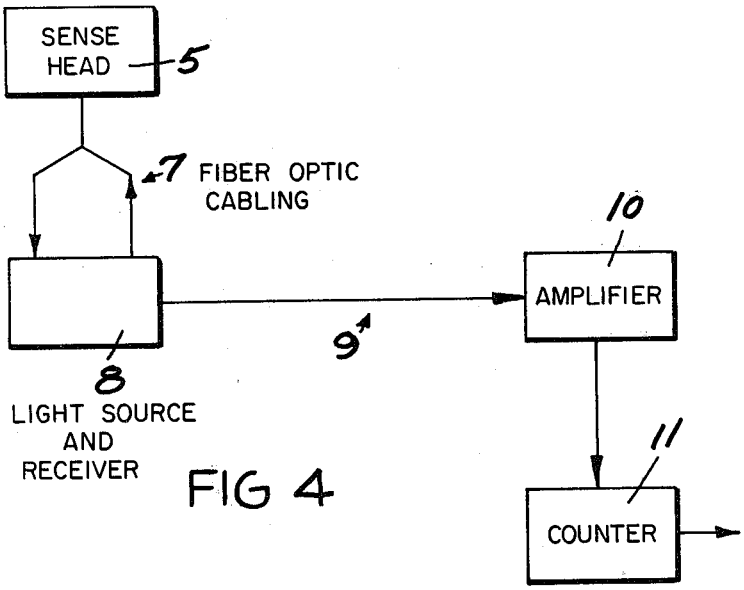
FIG. 4 is a block diagram of the electronic components of the present invention.

A sensor head 5 is located directly below the surface of the bridge at the intersection of the articles' path of travel and the vertical centerline of the drum (see FIGS. 1 and 2). A preferred circuit for implementing the invention is shown in FIG. 4. The sense head 5 is connected to a light source and receiver 8 with fiber optic cabling 7. In operation, the light source emits a light through the cable and out of the sense head. If an object is present at the sense head, light is reflected back through the cable and that reflection is detected by the receiver, which develops a signal signifying "present". When no object is present, the light source and receiver detects the lack of reflection and develops an "absent" signal. A signal amplifier 10 amplifies the signals and feeds them into a counter 11 which combines "present" and "absent" signals to index the cumulative count by one. The preferred embodiment uses a Banner Model BA235 sense head, a Banner Model FO2-T light source and receiver, a Scanamatic Type T-3100L amplifier, and an Accu-Ray 7000-M counting circuitry, but other similar components known in the art may be substituted within the scope of the present invention. In addition, the counter output signals may be processed in a variety of ways, either to furnish input to control circuitry or to provide management information.

The operation of the invention is shown in FIGS. *3a*, *3b*, *3c* and *3d*. In FIG. *3a*, the lead article *6a* of a stream of articles *6b*, etc., is moving in direction A toward the drum 2. The sense head 5 is uncovered so that the circuit of FIG. 4 develops an "absent" signal. In FIG. *3b*, the lead article has been pushed forward by following articles to a point directly under the left (from the direction of travel) side of the drum. The sense head is now covered, and the circuit develops a "present" signal. In FIG. *3c*, the rotation of the drum causes the side of the helical groove to push the article sideways (see also FIG. 2) in direction B. At the same time, the following articles *6b*, etc., continue to push the lead article forward in direction A. The combined effect of these two forces is to move the article obliquely in direction C. FIG. *3d* shows the article at the end of oblique movement. The momentum of the previous forward movement causes the article to continue moving in direction A, although in other embodiments another source of forward motion, such as a conveyor, might be added. The sense head 5 is now uncovered, developing an "absent" signal. The counter 11 combines the "present" and "absent" signals in a manner known in the art to index the count. The second article *6b* moves in direction A to repeat the cycle, followed by succeeding articles *6c*, etc.

The problems encountered by the prior art can be seen readily in FIGS. *3a–3d*. If the stream of articles were not jogged by the helical drum, a sensor would perceive the stream as a single, long article. Even were an accelerating means provided, differences in diameter would result in some articles not being accelerated, thus throwing off the count. In contrast, the present invention can operate with totally indeterminate spacing, because it creates gaps by diverting the product stream.

I claim:

1. A method for counting articles fed in a continuous stream, comprising the steps of:

conveying successive lead articles in a direction of travel;

detecting the presence of said lead articles;

accelerating said lead articles transverse to said direction of travel; said lead articles being maintained in a position oriented substantially parallel to said direction of travel;

sensing the absence of said lead articles before the rearmost portion of said lead article passes beyond said detecting means; and developing signals based on said detecting and sensing steps.

2. Apparatus for counting articles fed in a continuous stream, comprising:

means for detecting the presence or absence of articles in a detection zone and generating signals responsive to same;

means for conveying successive lead articles in a direction of travel into said detection zone so that said detecting means detects the presence of said lead article;

means for accelerating said lead article transversely to said direction of travel while retaining said lead article oriented substantially parallel to said direction of travel such that said acceleration commences after said detecting means detects the presence of said lead article, said acceleration being effective to cause the rearmost portion of said lead article to describe a path of motion entirely outside said detection zone.

3. Apparatus of claim 2, further including means for accumulating said signals.

4. Apparatus of claim 2, wherein said accelerating means comprises a drum having a helical groove formed on its peripheral surface.

5. Apparatus of claims 2, 3 or 4 wherein said detecting means comprises:

(a) a photoelectric reflective scanner located directly below said accelerating means; and (b) signal amplification means connected to said scanner for amplifying the output of said scanner.

* * * * *

UNITED STATES PATENT AND TRADEMARK OFFICE

CERTIFICATE OF CORRECTION

PATENT NO. :4,390,779

DATED :June 28, 1983

INVENTOR(S) :Rodney W. Hiekel

It is certified that error appears in the above-identified patent and that said Letters Patent is hereby corrected as shown below:

On the title page Item (75) Inventor:

"Heikel" should read -- Hiekel --.

Claim 1, line 11: "articles" should read -- article --.

Signed and Sealed this

*Eighth* Day of *May 1984*

[SEAL]

*Attest:*

GERALD J. MOSSINGHOFF

*Attesting Officer*

*Commissioner of Patents and Trademarks*